United States Patent [19]

Nakahama et al.

[11] Patent Number: 4,559,018

[45] Date of Patent: Dec. 17, 1985

[54] OUTBOARD MOTOR

[75] Inventors: Ryoji Nakahama, Iwata; Norimichi Harada; Seiji Wada, both of Shizuoka; Yoshio Hosono, Hamamatsu; Tetsuya Tomoda, Mori; Susumu Yukishima, Shizuoka, all of Japan

[73] Assignees: Yamaha Hatsudoki Kabushiki Kaisha; Sanshin Kogyo Kabushiki Kaisha, both of Japan

[21] Appl. No.: 498,166

[22] Filed: May 25, 1983

[30] Foreign Application Priority Data

Jul. 5, 1982 [JP] Japan ..... 57-115484

[51] Int. Cl.[4] ..... B63H 21/26

[52] U.S. Cl. ..... 440/77; 440/53; 440/900; 248/642

[58] Field of Search ..... 123/193 C, 197 C, 198 E, 123/197 R; 440/75, 52–56, 900, 58–63, 65, 67, 76–79, 89; 248/641, 642

[56] References Cited

U.S. PATENT DOCUMENTS

| | | | |
|---|---|---|---|
| 2,207,372 | 7/1940 | Clarke | 440/89 |
| 2,216,496 | 10/1940 | MacKay | 440/89 |
| 2,691,954 | 10/1954 | Shively | 440/75 |
| 3,083,678 | 4/1963 | Leipert | 440/89 |
| 3,911,853 | 10/1975 | Strang | 440/89 |
| 4,354,847 | 10/1982 | Blanchard | 440/61 |
| 4,354,848 | 10/1982 | Hall et al. | 440/61 |
| 4,355,986 | 10/1982 | Stevens | 440/53 |
| 4,362,513 | 12/1982 | Hall et al. | 440/61 |
| 4,363,629 | 12/1982 | Hall et al. | 248/642 |
| 4,367,860 | 1/1983 | Strang | 248/641 |
| 4,382,796 | 5/1983 | Blanchard | 440/75 |
| 4,382,797 | 5/1983 | Blanchard | 440/53 |
| 4,408,994 | 10/1983 | Blanchard | 440/75 |
| 4,449,945 | 5/1984 | Ferguson | 440/900 |

*Primary Examiner*—Trygve M. Blix
*Assistant Examiner*—Thomas J. Brahan
*Attorney, Agent, or Firm*—Ernest A. Beutler

[57] ABSTRACT

Two embodiments of improved compact outboard motors that are designed so that the power head does not encroach into the associated watercraft forwardly of the hull when the motor is tilted up about its tilt axis. In each embodiment, the internal combustion engine of the power head is located in such a way that it can be conveniently serviced and yet will note encroach when the motor is tilted up. In one embodiment, the engine is disposed with its output shaft extending transversely and its cylinders inclined rearwardly. In the other embodiment, the cylinders are aligned and extend vertically so that the engine output shaft extends perpendicularly to the associated hull.

26 Claims, 4 Drawing Figures

OUTBOARD MOTOR

BACKGROUND OF THE INVENTION

This invention relates to an outboard motor and more particularly to an improved, compact outboard motor.

Basically, all outboard motors comprise three main components, the power head in which the engine is positioned, the drive shaft housing through which the drive shaft extends and the lower unit where the propeller is supported and driven. In addition, the motors are constructed for attachment to the transom of the associated watercraft for steering movement about a generally vertically extending steering axis and for tilting movement about a generally horizontally disposed tilt axis.

Because of the arrangement of the components, particularly when the engine has multiple cylinders, the motor has a tendency to encroach on the watercraft area when it is in a tilted up condition. That is, normal outboard motor tilting arrangements are disposed in relation to the power head so that when the motor is tilted up, the power head will partially extend over the transom into the rear area of the boat. Such an arrangement has a number of disadvantages.

It has been proposed to provide outboard motor mounting arrangements wherein the tilt axis is disposed above or at the top level of the power head so that when the motor is tilted up, the power head will not extend into the boat. Although such constructions solve the problem of encroachment of the power head into the boat when tilted up, the low mounting of the power head makes servicing difficult. That is, if servicing of the motor is required in the water, the operator must lean over the transom a substantial distance to work on the motor.

It is, therefore, a principal object of this invention to provide an improved construction for an outboard motor.

It is another object of the invention to provide a compact outboard motor sturcture and tilting arrangement so that the motor will not encroach on the area of the boat when it is tilted up and yet the power head is disposed in an area where it may be conveniently serviced.

SUMMARY OF THE INVENTION

A first feature of this invention is adapted to be embodied in an outboard motor having a power head containing an internal combustion engine, a housing depending from the power head and containing a drive shaft rotating about a generally vertically extending axis and a lower unit journaling a propeller driven by the drive shaft. Means are provided for detachably connecting the motor to the hull of an associated watercraft and for permitting pivotal movement of the motor about a generally horizontally disposed tilt axis relative to the watercraft. In accordance with this feature of the invention, the engine is disposed with its output shaft extending in non-parallel, non-aligned relationship with the drive shaft. Means are provided for driving the drive shaft from the engine output shaft. The tilt axis is disposed contiguous to the uppermost surface of the power head when the motor is in a tilted down state.

Another feature of the invention is also adapted to be embodied in an outboard motor having a power head containing an internal combustion engine, a housing depending from the power head and containing a drive shaft rotating about a generally vertically extending axis and a lower unit journaling a propeller driven by the drive shaft. Means are provided for detachably connecting the motor to the transom of an associated watercraft and for permitting pivotal movement of the motor relative to the transom about a generally horizontally disposed tilt axis. In accordance with this feature of the invention, the engine is disposed with its output shaft extending in non-parallel, non-aligned relationship with the drive shaft. Means drive the drive shaft from the engine output shaft. The tilt axis is disposed relative to the power head so that when the motor is tilted up, the power head will not encroach into the area of the watercraft forwardly of the transom.

DETAILED DESCRIPTION OF THE PREFERRED EMBODIMENTS

Figure 1:
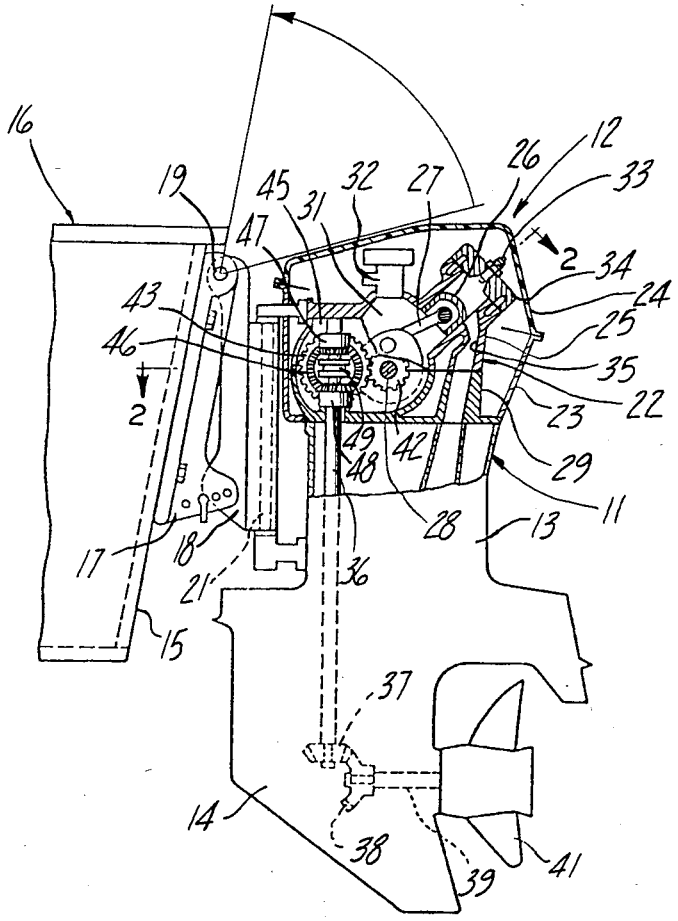
FIG. 1 is a side elevational view of an outboard motor constructed in accordance with a first embodiment of the invention as attached to the transom of an associated watercraft and with portions broken away.
Figure 2:
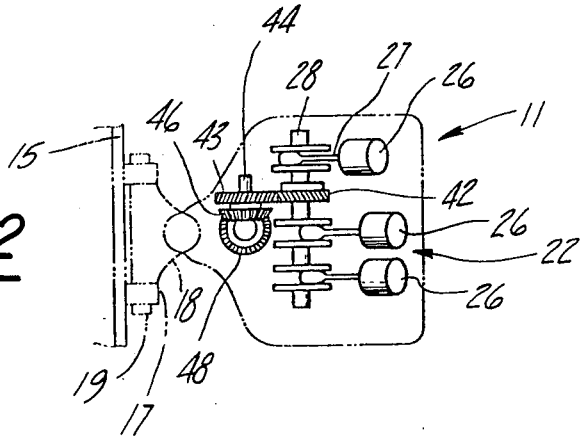
FIG. 2 is a partially schematic view taken generally along the line 2—2 of FIG. 1 and shows the layout of the engine.

Embodiment Of FIGS. 1 and 2

An outboard motor constructed in accordance with a first embodiment of the invention is identified generally by the reference numeral 11. The outboard motor 11 includes a power head, indicated generally by the reference numeral 12, a drive shaft housing 13 and a lower unit 14. The motor 11 is adapted to be attached to a transom 15 of an associated watecraft, shown partially and identified generally by the reference numeral 16, in a manner to be described.

A transom bracket 17 is affixed in a suitable manner to the transom 15 and carries a swivel bracket assembly 18 by means including a tilt pin 19 for pivotal movement of the motor 11 relative to the transom 15 about a generally horizontally disposed tilt axis defined by the tilt pin 19. A steering shaft 21 is journaled in the swivel bracket 18 and is affixed in a suitable manner to the motor 11 so as to permit steering of the motor 11 relative to the swivel bracket 18 about a generally vertically extending steering axis as defined by the steering shaft 21. It will be readily apparent from the drawings that the steering shaft 21 is affixed at its upper end to the internal combustion engine, to be described, and at its lower end to the drive shaft housing 13 by means of respective brackets.

The power head 12 includes an internal combustion engine 22 that is contained within a protective cowling comprising a lower part 23 and an upper part 24. The motor 22 is depicted as being of the three cylinder two-cycle type and includes a cylinder block 25 having cylinder bores in which pistons 26 are supported for reciprocation. The pistons 26 in turn are connected to one end of connecting rods 27, the other ends of which are journaled on a crankshaft 28 that is supported for rotation within a crankcase 29. Unlike conventional outboard motors, the engine crankshaft 28 rotates about an axis that is generally horizontally disposed and is non-aligned and non-parallel to the axis of the drive shaft which will be described.

The crankcase 29 defines a plurality of sealed chambers 31, there being one such chamber associated with each piston 26. A fuel/air mixture is delivered to each crankcase chamber 31 by means of a carburetor 32 in a known manner. The charge is compressed in the crankcase chamber 31 and is transferred through scavenge passage (not shown) to the upperside of the piston 26 for firing by means of a spark plug 33 carried in a cylinder head 34 which is affixed in a suitable manner to the cylinder block 25. The exhaust gases are discharged through exhaust ports 35 formed in the cylinder block 25 and crankcase 29 for discharge through an exhaust system contained within the drive shaft housing 13 and lower unit 14 and which may be of any known type.

A drive shaft 36 extends from the power head 22 vertically through the drive shaft housing 13 and terminates in the lower unit 14. The drive shaft 36 is supported for rotation in any suitable manner and has affixed to its lower end a bevel gear 37. The bevel gear 37 meshes with a driven bevel gear 38 that is affixed to a propeller shaft 39 which is journaled in the lower unit 14 in a suitable manner. A propeller 41 is affixed to the propeller shaft 39 for driving the watercraft 16. It is the normal practice with outboard motors to employ a forward/reverse/neutral transmission in the lower unit. In accordance with this embodiment of the invention, however, such a transmission is positioned within the power head and will now be described.

A drive gear 42 which may be of the spur or helical type is affixed to the crankshaft 28 between a pair of its throws. In the illustrated embodiment, the drive gear 42 is affixed to the crankshaft 28 between the first and second cylinders. The drive gear 42 meshes with a spur or helical driven gear 43 that is journalled on a stub shaft 44 which is, in turn, suitably journaled in the crankcase 29 of the engine 22. This portion of the crankcase defines a transmission cavity 45.

A bevel gear 46 is affixed to the stub shaft 44 and rotates simultaneously with the driven gear 43. Journaled on the upper end of the drive shaft 36 on opposite sides of the bevel gear 46 and in mesh with it are a forward bevel gear 47 and a reverse bevel gear 48. The bevel gears 47 and 48 are continuously engaged with the driving gear 46 and are continuously rotated in opposite directions due to their engagement with this gear. A dog clutch element 49 is positioned between the gears 47 and 48 and is splined to the drive shaft 36 so as to be axially movable along it while establishing a driving relationship therebetween. A suitable actuating mechanism is incorporated for moving the clutch element 49 axially along the drive shaft 36 so that jaws on it may selectively engage with corresponding jaws on the gears 47 or 48 so as to establish either a forward or reverse driving relationship between the engine and the drive shaft 36. The dog clutch 49 is also positionable so that neither gear is drivingly coupled with the drive shaft 36 to establish a neutral condition. This type of transmission is well known in this art but, as has been noted, is normally positioned in the lower unit.

Because of the inclined nature of the cylinder bores of the engine 22 and the fact that the crankshaft 28 rotates about an axis that is not aligned with the drive shaft 36, it is possible to maintain a relatively low profile for the power head 12. In addition, the tilt pin 19 is positioned at a level substantially equal to the upper most forward edge of the protective cowling member 24 so as to maintain a relatively compact nature. As may be seen in FIG. 1, the motor 11 may be pivoted about the axis defined by the tilt pin 19 from the normal position upwardly through the angle $\theta$ to a tilted up position. When tilted through this angle, the power head 12 will not encroach in the area forward of the transom 15. Thus, the power head will not interfere with the occupants of the boat even when the motor is tilted up. On the other hand, the power head 12 is positioned at a relatively high level and substantially parallel to the top of the transom 15 so that the motor 22 may be conveniently serviced while attached to the transom through removal of the protective cowling 24. Thus, a compact and nevertheless serviceable unit is provided.

Figure 3:
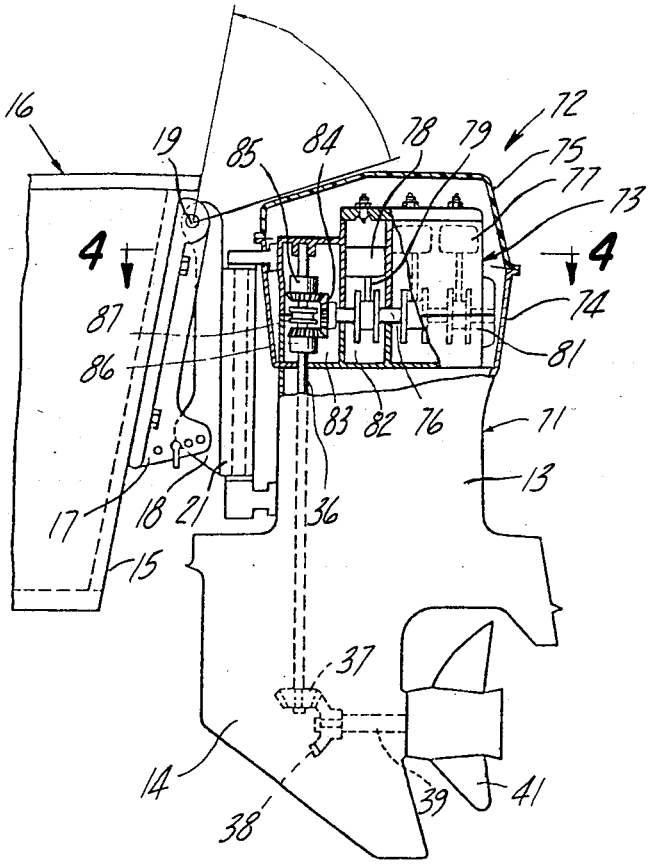
FIG. 3 is a side elevational view, in part similar to FIG. 1, showing another embodiment of the invention.
Figure 4:
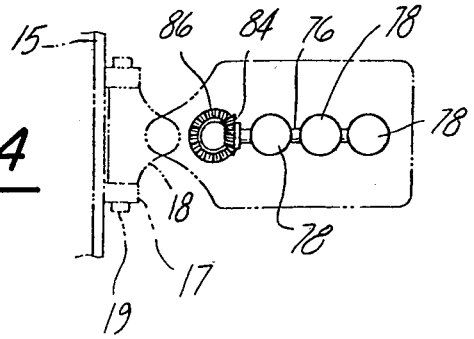
FIG. 4 is a partially schematic view, in part similar to FIG. 2, taken along the line 4—4 of FIG. 3.

Embodiment of FIGS. 3 And 4

An outboard motor constructed in accordance with a second embodiment of the invention is identified generally by the reference numeral 71. Except for the construction of the power head, this embodiment is the same as the previously described embodiment. Therefore, all components other than the power head have been indentified by the same reference numerals as used in conjunction with the embodiment of FIGS. 1 and 2 and these components will not be described again, except insofar as is necessary to understand this embodiment. Like the embodiment of FIGS. 1 through 3, the steering shaft 21 is affixed, by upper and lower brackets, to the internal combustion engine, to be described, and the drive shaft housing 13.

In this embodiment, a power head 72 includes an internal combustion engine 73 that is contained within a protective cowling comprises of a lower member 74 and an upper member 75. In this embodiment, the engine 73 is also of the three cylinder, two-cycle type. However, in this embodiment, the engine 73 is positioned so that its crankshaft 76 is supported for rotation about an axis that extends longitudinally of the watercraft 16 rather than transversely to it as in the embodiment of FIGS. 1 and 2. However, the axis of rotation of the crankshaft 76 is non-parallel and non-aligned with the axis of rotation of the drive shaft 36. The engine 73 includes a cylinder block 77 having cylinder bores in which pistons 78 are supported for reciprocation. The pistons 78 are connected to connecting rods 79 which are, in turn, journaled at their lower ends on the crankshaft 76 in a known manner. The crankshaft 76 is supported for rotation between the cylinder block 77 and a crankcase 81.

The crankcase 81 defines individual sealed chambers 82 associated with each of the pistons 78 and to which a fuel/air mixture is introduced from carburetors in a known manner. As with the previously described embodiment, this mixture is compressed within the crankcase chambers 82, transferred to the area above the pistons 78 for firing by spark plugs and for exhaust through an exhaust system of a suitable type.

In this embodiment, the crankcase is formed with a transmission chamber 83 at its forward end. A bevel driving gear 84 is fixed to the crankshaft 76 in the transmission chamber 83 and meshes with a forward bevel gear 85 and a reverse bevel gear 86 which are disposed on opposite sides of the driving gear 84 and which are journaled in a known manner on the drive shaft 36. As with the previously described embodiment, a dog clutching element 87 is positioned between the gears 85 and 86 for selectively coupling either of these gears to the drive shaft 36 so as to drive the drive shaft 36 and propeller 41 in either a forward or reverse condition. As aforedescribed, the clutch dog 87 is also adapted to be positioned in a neutral position so that the engine 73 may operate without driving the drive shaft 76.

Even though the cylinders of the engines are disposed so that they extend vertically, the crankshaft 76 is mounted relatively low in the power head 72 so that the overall profile of the motor will be low. The tilt axis 19 is disposed substantially at the level of the lowermost front corner of the top cowling piece 75 and, as with the previously described embodiment, tilting movement of the motor 71 about the tilt axis 19 through the angle $\theta$ will not affect any encroachment of the power head 72 forwardly of the transom 15. However, the power head 72 is relatively highly positioned so that it may be conveniently serviced when attached to the transom 15.

It should be readily apparent from the foregoing description that two embodiments of the invention have been disclosed, each of which provides a relatively compact outboard motor arrangement that will not encroach into the watercraft when the motor is tilted up but which nevertheless positions the engine of the power head at a level so that it may be conveniently serviced when attached to the transom. Although two embodiments of the invention have been illustrated and described, various changes and modifications may be made without departing from the spirit and scope of the invention, as defined by the appended claims.

We claim:

1. In an outboard motor having a power head containing an internal combustion engine, a housing depending from said power head and containing a drive shaft rotating about a generally vertically extending axis, a lower unit journaling a propeller driven for rotation about an axis generally perpendicular to said drive shaft axis by said drive shaft, and means for detachably connecting said motor to the hull of an associated watercraft and for permitting pivotal movement of said motor relative to said hull about a generally horizontally disposed tilt axis and about a generally vertically extending steering axis defined by a steering shaft, the improvement comprising said engine being disposed with its output shaft extending in non-parallel, non-alignment relation with said drive shaft, means for driving said drive shaft from said engine output shaft, the upper end of said steering shaft being juxtaposed to said tilt axis, said tilt axis being disposed contiguous to the uppermost surface of said power head when said outboard motor is in a tilted down state, the upper surface of said power head not extending above a horizontal plane substantially parallel to the upper edge of the hull of the associated watercraft when attached thereto and in a tilted down state, means for directly affixing said engine to said steering shaft at the upper end of said steering shaft and means for affixing said housing to said steering shaft adjacent the lower end of said steering shaft.

2. In an outboard motor as set forth in claim 1 wherein the engine is a reciprocating engine having a plurality of cylinders.

3. In an outboard motor as set forth in claim 2 wherein the cylinders are aligned with each other.

4. In an outboard motor as set forth in claim 3 wherein the cylinders extend generally vertically when the outboard motor is in its tilted down condition.

5. In an outboard motor as set forth in claim 4 wherein the output shaft of the engine comprises a crankshaft rotating about an axis that extends generally perpendicularly to the hull of the associated watercraft.

6. In an outboard motor as set forth in claim 3 wherein the cylinders are inclined to the vertical.

7. In an outboard motor as set forth in claim 6 wherein the output shaft comprises a crankshaft rotating about an axis that extends transversely to the associated watercraft.

8. In an outboard motor as set forth in claim 3 wherein the cylinders have the axes of their bores lying in a plane that extends transversely to the watercraft.

9. In an outboard motor as set forth in claim 1 further including a foward/neutral/reverse transmission contained within the power head and forming the means for driving the drive shaft from the engine output shaft.

10. In an outboard motor as set forth in claim 9 wherein the transmission is disposed forwardly of the internal combustion engine.

11. In an outboard motor as set forth in claim 10 wherein the engine is a reciprocating type with multiple cylinders and the input to the transmission is taken from a crankshaft of the engine between a pair of cylinders.

12. In an outboard motor as set forth in claim 11 wherein the crankshaft has a gear affixed to it in mesh with a gear of the transmission for driving the transmission.

13. In an outboard motor as set forth in claim 10 wherein there is a bevel gear affixed to the engine output shaft and in mesh with a pair of driven bevel gears that are rotated in opposite directions and further including clutch means for selectively coupling said driven gears to said drive shaft for driving said drive shaft in selected directions.

14. In an outboard motor having a power head containing an internal combustion engine, a housing depending from said power head and containing a drive shaft rotating about a generally vertically extending axis, a lower unit journaling a propeller driven by said drive shaft for rotation about an axis perpendicular to said drive shaft axis, and means for detachably connecting said motor to the hull of an associated watercraft and for pivotal movement of said motor relative to said hull about a horizontally disposed tilt axis and about a generally vertically extending steering axis defined by a steering shaft, the improvement comprising said engine being disposed with its output shaft extending in non-parallel, non-aligned relationship with said drive shaft, means for driving said drive shaft from said,engine output shaft, the upper end of said steering shaft being juxtaposed to said tilt axis, and said tilt axis being located so that said power head does not extend forwardly of the hull when the outboard motor is tilted about the tilt axis from its tilted down position to a tilted up position, the upper surface of said power head not extending above a horizontal plane substantially parallel to the upper end of the hull of the associated watercraft when attached thereto and in a tilted down state, means for directly affixing said engine to said steering shaft at the upper end of said steering shaft, and means for affixing said housing to said steering shaft adjacent the lower end of said steering shaft.

15. In an outboard motor as set forth in claim 14 wherein the engine is a reciprocating engine having a plurality of cylinders.

16. In an outboard motor as set forth in claim 15 wherein the cylinders are aligned with each other.

17. In an outboard motor as set forth in claim 16 wherein the cylinders extend generally vertically when the outboard motor is in its tilted down condition.

18. In an outboard motor as set forth in claim 17 wherein the output shaft of the engine comprises a crankshaft rotating about an axis that extends generally perpendicularly to the hull of the associated watercraft.

19. In an outboard motor as set forth in claim 16 wherein the cylinders are inclined to the vertical.

20. In an outboard motor as set forth in claim 19 wherein the output shaft comprises a crankshaft rotating about an axis that extends transversely to the associated watercraft.

21. In an outboard motor as set forth in claim 16 wherein the cylinders have the axes of their bores lying in a plane that extends transversely to the watercraft.

22. In an outboard motor as set forth in claim 14 further including a foward/neutral/reverse transmission contained within the power head and forming the means for driving the drive shaft from the engine output shaft.

23. In an outboard motor as set forth in claim 22 wherein the transmission is disposed forwardly of the internal combustion engine.

24. In an outboard motor as set forth in claim 23 wherein the engine is a reciprocating type with multiple cylinders and the input to the transmission is taken from the crankshaft of the engine between a pair of cylinders.

25. In an outboard motor as set forth in claim 24 wherein the crankshaft has a gear affixed to it in mesh with a gear of the transmission for driving the transmission.

26. In an outboard motor as set forth in claim 23 wherein there is a bevel gear affixed to the engine output shaft and in mesh with a pair of driven bevels gears that are rotated in opposite directions and further including clutch means for selectively coupling said driven gears to said drive shaft for driving said drive shaft in selected directions.

* * * * *

UNITED STATES PATENT AND TRADEMARK OFFICE

CERTIFICATE OF CORRECTION

PATENT NO. : 4,559,018

DATED : December 17, 1985

INVENTOR(S) : Nakahama et al

It is certified that error appears in the above-identified patent and that said Letters Patent is hereby corrected as shown below:

Abstract, line 7, "note" should be --not--.

Column 1, line 41, "sturcture" should be --structure--.

Column 2, line 39, "watecraft" should be --watercraft--.

Column 4, line 33, "comprises" should be --comprised--.

Column 5, lines 42-43, Claim 1, "non-alignment" should be --non-aligned--.

Column 6, line 11, Claim 9, "foward" should be --forward--.

Column 6, line 47, Claim 14, after "said" (second occurrence) delete ",".

Column 7, line 16, Claim 22, "foward" should be --forward--.

Column 8, line 14, Claim 26, "bevels" should be --bevel--.

Signed and Sealed this

*Thirtieth* Day of *September 1986*

[SEAL]

*Attest:*

DONALD J. QUIGG

*Attesting Officer*

*Commissioner of Patents and Trademarks*